US008002024B2

(12) United States Patent
Higashiyama

(10) Patent No.: US 8,002,024 B2
(45) Date of Patent: Aug. 23, 2011

(54) HEAT EXCHANGER WITH INLET HAVING A GUIDE

(75) Inventor: Naohisa Higashiyama, Oyama (JP)

(73) Assignee: Showa Denko K. K., Tokyo (JP)

( * ) Notice: Subject to any disclaimer, the term of this patent is extended or adjusted under 35 U.S.C. 154(b) by 1433 days.

(21) Appl. No.: 10/586,594

(22) PCT Filed: Mar. 23, 2005

(86) PCT No.: PCT/JP2005/006000

§ 371 (c)(1),
(2), (4) Date: Jul. 20, 2006

(87) PCT Pub. No.: WO2005/090891

PCT Pub. Date: Sep. 29, 2005

(65) Prior Publication Data

US 2008/0229771 A1 Sep. 25, 2008

Related U.S. Application Data

(60) Provisional application No. 60/556,370, filed on Mar. 26, 2004.

(30) Foreign Application Priority Data

Mar. 23, 2004 (JP) ..... 2004-084608
Mar. 15, 2005 (JP) ..... 2005-072696

(51) Int. Cl.
*F28F 9/02* (2006.01)
*F28D 1/02* (2006.01)

(52) U.S. Cl. ..... 165/174; 165/153

(58) Field of Classification Search ..... 165/153, 165/174
See application file for complete search history.

(56) References Cited

U.S. PATENT DOCUMENTS 673,767 A * 5/1901 Eycleshymer ..... 165/174
1,024,641 A * 4/1912 Mackie ..... 165/174
2,813,708 A * 11/1957 Frey ..... 165/9.3
3,706,534 A * 12/1972 Verheul et al. ..... 239/590.3
5,186,249 A * 2/1993 Bhatti et al. ..... 165/174
5,388,398 A * 2/1995 Kadambi et al. ..... 60/39.511
(Continued)

FOREIGN PATENT DOCUMENTS

JP 06-241614 9/1994
(Continued)

*Primary Examiner* — Cheryl J Tyler
*Assistant Examiner* — Brandon M Rosati
(74) *Attorney, Agent, or Firm* — Oblon, Spivak, McClelland, Maier & Neustadt, L.L.P.

(57) ABSTRACT

A heat exchanger 1 comprises a heat exchange core 4 composed of heat exchange tubes 12 in groups 13 in the form of two rows arranged in parallel in the direction of flow of air through the exchanger, a refrigerant inlet header 5 disposed on the upper-end side of the tubes 12 and having one row of heat exchange tubes 12 joined thereto and a refrigerant outlet header 6 disposed in the rear of the inlet header 5 on the upper-end side of the tubes 12 and having the other row of heat exchange tubes 12 joined thereto. A cap 19 for closing an opening of the inlet header 5 at one end thereof is provided with a refrigerant inlet 37. The cap 19 has a lower edge defining the inlet 37 and provided with a guide 40 upwardly slanting inwardly of the inlet header 5.

17 Claims, 10 Drawing Sheets

U.S. PATENT DOCUMENTS

| | | | | | |
|---|---|---|---|---|---|
| 5,465,783 | A | * | 11/1995 | O'Connor | 165/134.1 |
| 5,590,710 | A | * | 1/1997 | Sasaki et al. | 165/173 |
| 5,934,367 | A | * | 8/1999 | Shimmura et al. | 165/174 |
| 6,145,587 | A | * | 11/2000 | Hanafusa | 165/153 |
| 6,340,052 | B1 | * | 1/2002 | Uehara | 165/166 |
| 6,491,092 | B2 | * | 12/2002 | Nakado et al. | 165/152 |
| 6,923,251 | B2 | * | 8/2005 | Higashiyama | 165/153 |
| 6,973,805 | B2 | * | 12/2005 | Higashiyama | 62/525 |
| 6,997,250 | B2 | * | 2/2006 | Dilley et al. | 165/174 |
| 7,549,466 | B2 | * | 6/2009 | Hayashi et al. | 165/176 |
| 7,896,066 | B2 | * | 3/2011 | Higashiyama | 165/174 |
| 2002/0079093 | A1 | * | 6/2002 | Rong | 165/153 |
| 2003/0111210 | A1 | * | 6/2003 | Tsujita et al. | 165/51 |
| 2004/0159121 | A1 | * | 8/2004 | Horiuchi et al. | 62/526 |
| 2005/0126770 | A1 | * | 6/2005 | Higashiyama | 165/174 |
| 2009/0007592 | A1 | * | 1/2009 | Higashiyama | 62/515 |

FOREIGN PATENT DOCUMENTS

| | | | | |
|---|---|---|---|---|
| JP | 2002-340495 | | 11/2002 | |
| JP | 2003-075024 | | 3/2003 | |
| JP | 2005-164226 | * | 6/2005 | 165/174 |

* cited by examiner

HEAT EXCHANGER WITH INLET HAVING A GUIDE

CROSS REFERENCE TO RELATED APPLICATION

This application is an application filed under 35 U.S.C. §111(a) claiming the benefit pursuant to 35 U.S.C. §119(e)(1) of the filing date of Provisional Application No. 60/556,370, filed Mar. 26, 2004 pursuant to 35 U.S.C. §111(b).

TECHNICAL FIELD

The present invention relates to heat exchangers, more particularly to heat exchangers useful, for example, as evaporators in motor vehicle air conditioners which are refrigeration cycles to be installed in motor vehicles.

The term "aluminum" as used herein and in the appended claims includes aluminum alloys in addition to pure aluminum. The downstream side (the direction indicated by the arrow X in FIG. 1) of the air to be passed through the heat exchanger will be referred to herein and in the appended claims as "front," and the opposite side as "rear." The upper, lower, left-hand and right-hand sides of FIG. 2 will be referred to as "upper," "lower," "left" and "right," respectively.

BACKGROUND ART

Heretofore in wide use as motor vehicle air conditioner evaporators are those of the so-called stacked plate type which comprise a plurality of flat hollow bodies arranged in parallel and each composed of a pair of dishlike plates facing toward each other and brazed to each other along peripheral edges thereof, and a louvered corrugated fin disposed between and brazed to each adjacent pair of flat hollow bodies. In recent years, however, it has been demanded to provide evaporators further reduced in size and weight and exhibiting higher performance.

To meet such a demand, the present applicant has already proposed an evaporator which comprise a heat exchange core composed of tube groups in the form of two rows arranged in parallel in the direction of passage of air and each comprising a plurality of heat exchange tubes arranged at a spacing, a refrigerant inlet-outlet tank disposed at the upper end of the heat exchange core and a refrigerant turn tank disposed at the lower end of the heat exchange core, the refrigerant inlet-outlet tank having its interior divided by a partition into a refrigerant inlet header and a refrigerant outlet tank arranged side by side in the direction of passage of air, the inlet header being provided with a refrigerant inlet at one end thereof, the outlet header being provided with a refrigerant outlet at one end thereof alongside the inlet, the refrigerant turn tank having its interior divided by a partition wall into a refrigerant inflow header and a refrigerant outflow header arranged side by side in the direction of passage of air, the partition wall of the refrigerant turn tank having a plurality of refrigerant passing holes formed therein and arranged longitudinally of the wall at a spacing, the heat exchange tubes of the front tube group having upper ends projecting into and joined to the inlet header, the heat exchange tubes of the rear tube group having upper ends projecting into and joined to the outlet header, the heat exchange tubes of the front tube group having lower ends joined to the inflow header, the heat exchange tubes of the rear tube group having lower ends joined to the outflow header. A refrigerant flowing into the inlet header of the inlet-outlet tank flows through the heat exchange tubes of the front tube group into the inflow header of the turn tank, then flows into the outflow header through the refrigerant passing holes in the partition wall and further flows into the outlet header of the inlet-outlet tank through the heat exchange tubes of the rear tube group (see the publication of JP-A NO. 2003-75024).

However, the present inventor has conducted extensive research and found that the evaporator disclosed in the above publication is likely to have the following problem because the inlet of the inlet header and the outlet of the outlet header are provided at the same end of the inlet-outlet tank, and further because the heat exchange tubes of the front group are joined to the inlet header with their upper ends projecting thereinto.

The portions of the heat exchange tubes projecting into the inlet header offer resistance to the refrigerant flowing in through the inlet, so that the refrigerant flowing into the inlet header encounters difficulty in flowing to a position remote from the inlet. Consequently, an increased amount of refrigerant flows into heat exchange tubes of the front tube group which are positioned close to the inlet to produce an increased refrigerant flow, while a reduced amount of refrigerant flows into heat exchange tubes positioned away from the inlet to produce a decreased refrigerant flow. Similarly in the rear tube group, heat exchange tubes positioned close to the inlet have an increased refrigerant flow, with a decrease in the refrigerant flow through those positioned away from the inlet. As a result, the amount of refrigerant flowing through the heat exchange core and contributing to heat exchange becomes uneven longitudinally of the inlet-outlet tank, and the air passing through the heat exchange core also becomes uneven at some location. Thus, the evaporator fails to exhibit fully improved heat exchange performance. This problem becomes more pronounced especially when the refrigerant flow rate is low.

An object of the present invention is to overcome the above problem and to provide a heat exchanger which is outstanding in heat exchange performance.

DISCLOSURE OF THE INVENTION

To fulfill the above object, the present invention has the following modes.

1) A heat exchanger comprising a refrigerant inlet header and a refrigerant outlet header arranged side by side in a front-rear direction at an upper end of the heat exchanger, and a refrigerant circulating passage for holding the two headers in communication therethrough, the inlet header having a refrigerant inlet at one end thereof, the outlet header having a refrigerant outlet at one end thereof alongside the inlet, a refrigerant being flowable into the inlet header from the inlet and thereafter returnable to the outlet header through the circulating passage so as to be sent out from the heat exchanger through the outlet, the refrigerant inlet being provided in a closing member closing an opening of the inlet header at said end thereof, the closing member having a lower edge defining the inlet and provided with a guide slanting upward inwardly of the inlet header.

2) A heat exchanger according to par. 1) wherein the guide is in the form of a segment of a sphere.

3) A heat exchanger according to par. 1) wherein the refrigerant inlet of the inlet header is circular and has an inside diameter of 3 to 8.5 mm.

4) A heat exchanger according to par. 1) wherein the guide has a projecting end face positioned on a slanting plane inclined with respect to a vertical inner surface of the closing member.

5) A heat exchanger according to par. 4) wherein the slanting plane having the projecting end face of the guide positioned thereon makes a minor angle of inclination of 15 to 60 degrees with the vertical inner surface of the closing member.

6) A heat exchanger according to par. 1) wherein the closing member has a first closing portion closing said end opening of the inlet header and a second closing portion closing an opening at said end of the outlet header alongside the inlet, the first closing portion being provided with the refrigerant inlet and the guide, the second closing portion being provided with the refrigerant outlet.

7) A heat exchanger according to par. 1) wherein the inlet header has a joint plate joined to said end thereof and having a refrigerant inlet portion in communication with the refrigerant inlet of the closing member, the refrigerant inlet of the inlet header having a center upwardly deviated from a center of the refrigerant inlet portion of the joint plate.

8) A heat exchanger according to par. 7) wherein the deviation of the center of the refrigerant inlet of the inlet header from the center of the refrigerant inlet portion is 0.5 to 3 mm.

9) A heat exchanger according to par. 7) wherein the joint plate extends across and is joined to both the inlet header and the outlet header, and the plate has a refrigerant outlet portion communicating with the refrigerant outlet in addition to the refrigerant inlet portion in communication with the refrigerant inlet.

10) A heat exchanger according to par. 9) wherein a refrigerant inlet pipe is joined to the refrigerant inlet portion of the joint plate, and a refrigerant outlet pipe is joined to the refrigerant outlet portion thereof.

11) A heat exchanger according to par. 10) wherein the inlet pipe has a constricted portion formed at an end portion thereof and inserted into the refrigerant inlet portion of the joint plate, and the outlet pipe has a constricted portion formed at an end portion thereof and inserted into the refrigerant outlet portion of the joint plate, the inlet pipe and the outlet pipe being joined to the joint plate.

12) A heat exchanger according to par. 9) wherein the joint plate has joined thereto an expansion valve mount member having two refrigerant passageways communicating with the refrigerant inlet portion and the refrigerant outlet portion respectively.

13) A heat exchanger according to par. 1) wherein the refrigerant circulating passage comprises a plurality of intermediate headers and a plurality of heat exchange tubes.

14) A heat exchanger according to par. 1) wherein the outlet header is disposed in the rear of the inlet header, and the refrigerant circulating passage comprises a refrigerant inflow intermediate header disposed below and opposed to the inlet header, a refrigerant outflow intermediate header disposed below and opposed to the outlet header and a plurality of heat exchange tubes, the inflow intermediate header being in communication with the outflow intermediate header, the plurality of heat exchange tubes being arranged at a spacing between each of the opposed pair of inlet header and inflow intermediate header and the opposed pair of outlet header and outflow intermediate header to provide a tube group in the form of at least one row and constitute a heat exchange core, the heat exchange tubes of the tube group having opposite ends joined to the respective headers opposed to each other.

15) A heat exchanger according to par. 14) wherein the outlet header has interior partitioned by dividing means into first and second two spaces arranged in the direction of height, and the heat exchange tubes extend into the first space, the dividing means being provided with a refrigerant passing hole, the second space of the outlet header being in communication with the refrigerant outlet.

16) A heat exchanger according to par. 14) wherein the inlet header and the outlet header are provided by dividing interior of one refrigerant inlet-outlet tank into a front and a rear portion by separating means.

17) A heat exchanger according to par. 16) wherein the inlet-outlet tank comprises a first member having the heat exchange tubes joined thereto, a second member brazed to the first member at a portion thereof opposite to the heat exchange tubes and closing members brazed to opposite ends of the first and second members, the separating means and the dividing means being integral with the second member.

18) A refrigeration cycle comprising a compressor, a condenser and an evaporator, the evaporator comprising a heat exchanger according to any one of pars. 1) to 17).

19) A vehicle having installed therein a refrigeration cycle according to par. 18) as a vehicle air conditioner.

The heat exchanger according to par. 1) has a closing member closing an opening of the inlet header at one end thereof and provided with a refrigerant inlet. The closing member has a lower edge defining the inlet and provided with a guide slanting upward inwardly of the inlet header. Accordingly, the refrigerant flowing into the inlet header flows obliquely upward by being guided by the guide, is allowed to flow through the inlet header easily to locations remote from the inlet, and therefore flows through all the heat exchange tubes joined to the inlet header in uniform quantities and also through all the heat exchange tubes joined to the outlet header in uniform quantities. Consequently, the amount of refrigerant contributing to heat exchange is uniformalized in the heat exchange core of the refrigerant circulating passage longitudinally of the inlet header, and the air passing through the core is also uniformalized entirely in temperature, enabling the heat exchanger to exhibit remarkably improved heat exchange performance The impairment of heat exchange performance is precluded especially when the refrigerant is low in flow rate.

With the heat exchanger described in par. 2), the guide is in the form of a segment of a sphere and is therefore less likely to offer resistance to the flow of refrigerant.

The advantage of the heat exchanger according to par. 1) becomes more remarkable in the case of the heat exchanger described in par. 3).

The advantage of the heat exchanger according to par. 1) becomes more remarkable in the case of the heat exchanger described in pars. 4) and 5).

With the heat exchanger according to par. 6), the closing member serves for the inlet header and the outlet header in common. This reduces the number of components.

With the heat exchanger described in par. 7), the inlet of the inlet header is positioned as upwardly deviated from the refrigerant inlet portion of the joint plate, so that the advantage that the refrigerant flowing into the inlet header through the inlet is caused to flow obliquely upward by the guide becomes more pronounced, permitting the refrigerant to flow more smoothly through the inlet header to locations remote from the inlet to effectively uniformalize all the heat exchange tubes in the flow of refrigerant therethrough.

The advantage of the heat exchanger described in par. 7) becomes more remarkable with the heat exchanger according to par. 8).

With the heat exchanger according to par. 9), the joint plate serves for the inlet header and the outlet header in common. This reduces the number of components.

With the heat exchanger according to par. 10), a refrigerant inlet pipe is joined to the refrigerant inlet portion of the joint plate, with a refrigerant outlet pipe joined to the refrigerant outlet portion thereof. According to par. 11), end portions of the inlet pipe and the outlet pipe are constricted and inserted into the inlet portion and the outlet portion, respectively. This considerably diminishes the outside diameter of the inlet portion and the outlet portion, consequently giving a relatively greater spacing between the inlet portion and the outlet portion. Even when the front-to-rear dimension of the joint plate is restricted, therefore, an increased area is available for the joint of the portion of the joint plate between the inlet and outlet portions thereof with the inlet header and the outlet header, eliminating the occurrence of a fault in the joint and preventing short-circuiting of the inlet header and the outlet header. As a result, the refrigerant flowing in through the inlet pipe is prevented from entering the outlet pipe without passing through the refrigerant circulating passage and preventing the impairment of heat exchange performance of the exchanger. Furthermore, the provision of the constricted end portion on the inlet pipe increases the flow rate of the refrigerant when the refrigerant flows into the inlet header from the inlet pipe, permitting the refrigerant to spread to the other end of the inlet header with greater ease and improving the advantage of the heat exchanger described in par. 1).

With the heat exchanger according to par. 15), the dividing means functions to give improved uniformity to all the heat exchange tubes joined to the inlet header in the quantities of refrigerant flowing therethrough, further rendering all the heat exchange tubes joined to the outlet header uniform in the quantities of refrigerant flowing therethrough and enabling the exchanger to achieve a further improved heat exchange efficiency.

The heat exchanger described in par. 16) can be reduced in the number of components of the entire exchanger.

With the heat exchanger according to par. 17), the separating means and the dividing means of the inlet-outlet tank are integral with the second member. This renders these means easy to provide in the inlet-outlet tank.

BEST MODE OF CARRYING OUT THE INVENTION

An embodiment of the present invention will be described below with reference to the drawings. This embodiment is heat exchangers of the invention for use as an evaporator in motor vehicle air conditioners.

In the following description, the left-hand and right-hand sides of FIG. 2 will be referred to as "left" and "right," respectively.

Figure 1:
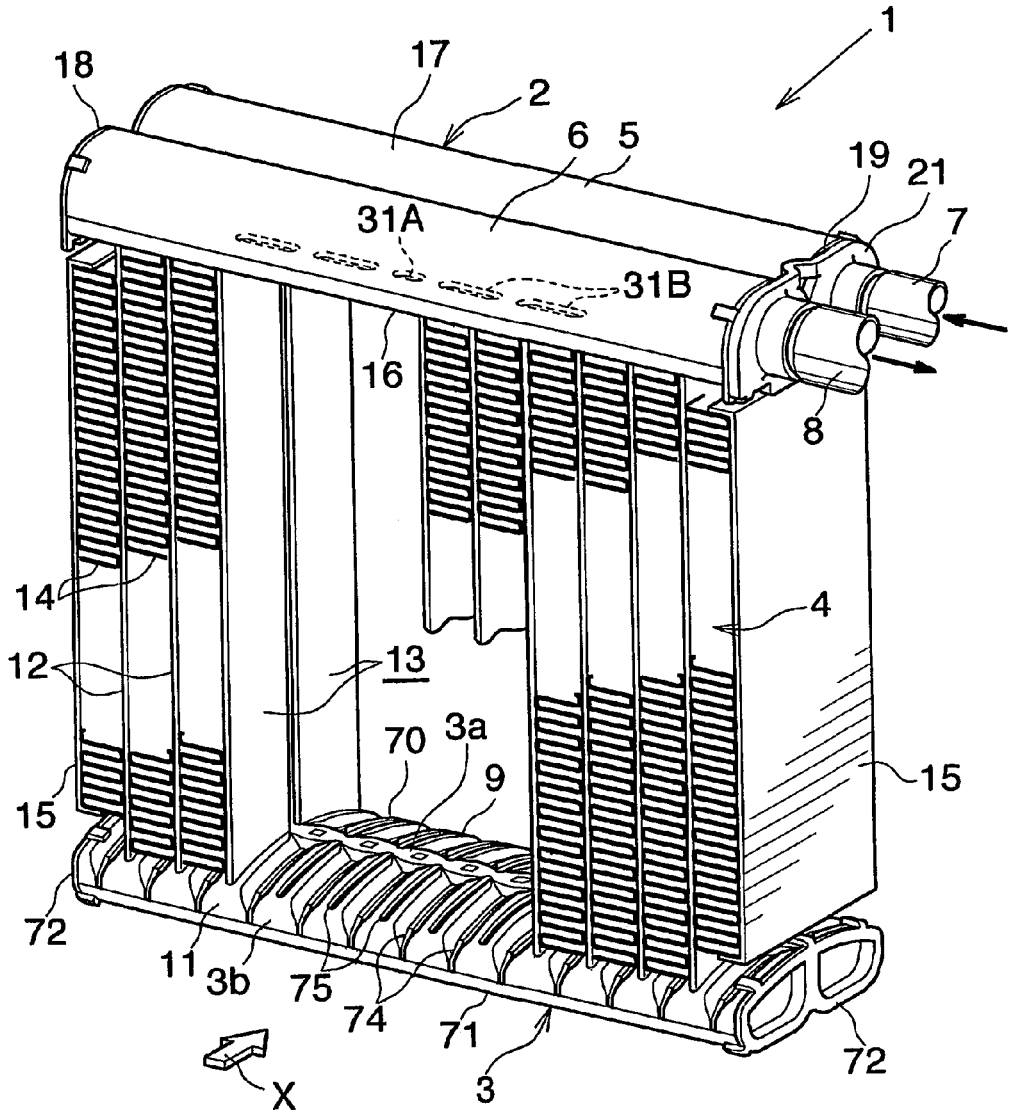
FIG. 1 is a perspective view partly broken away and showing the overall construction of a heat exchanger of the invention as adapted for use as an evaporator.
Figure 2:
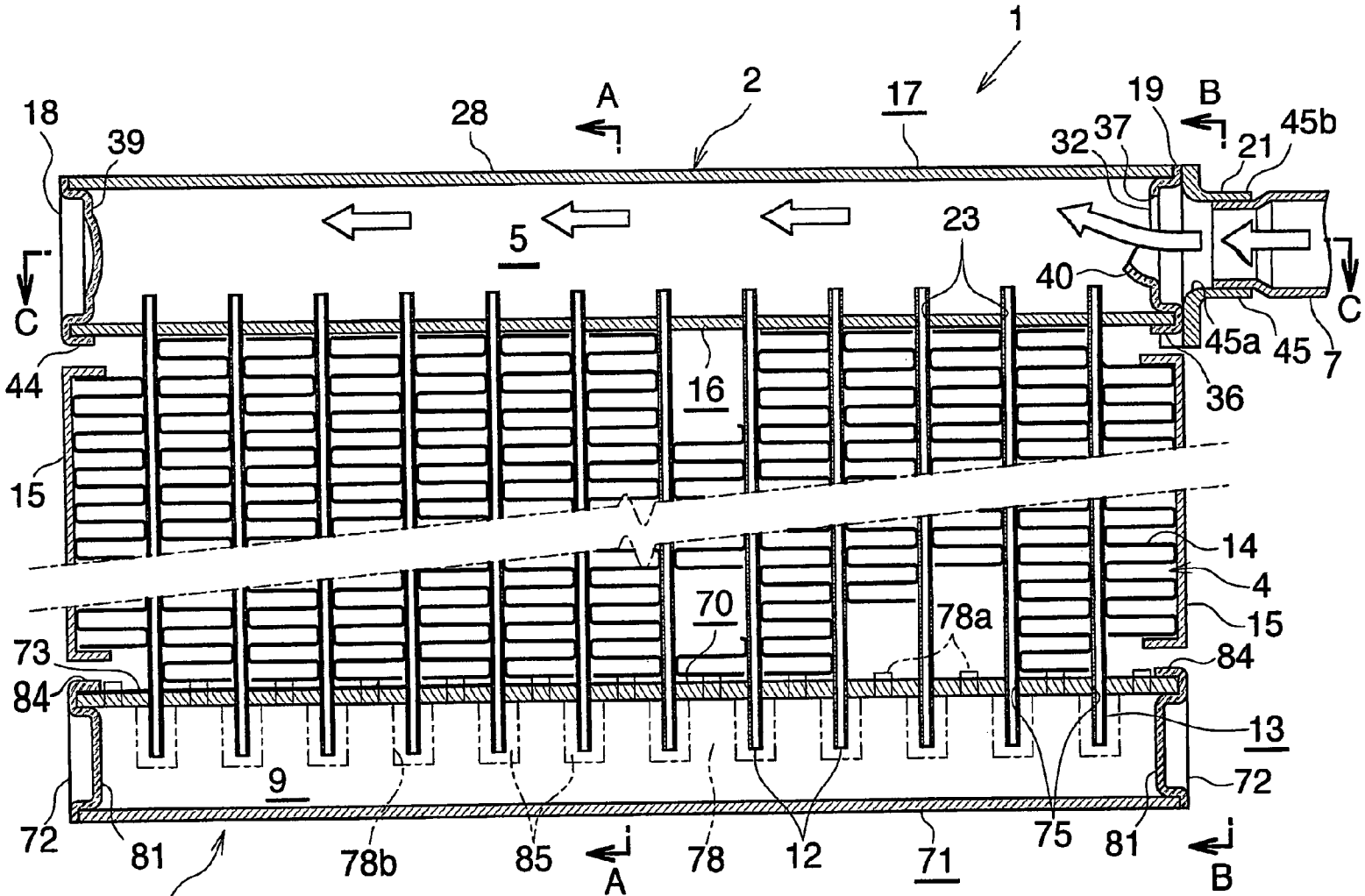
FIG. 2 is a view in vertical section and showing the evaporator of FIG. 1 with an intermediate portion omitted.
Figure 3:
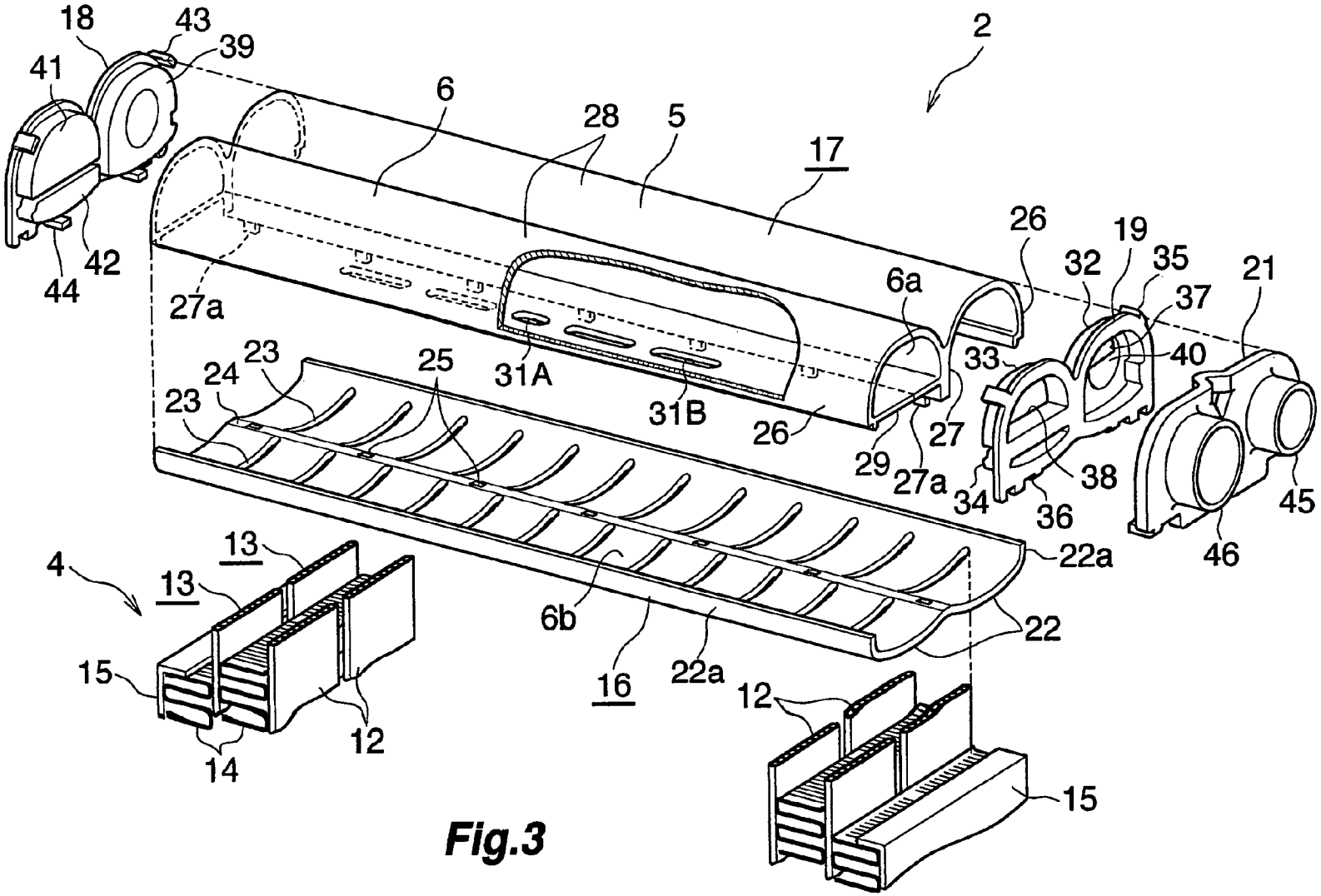
FIG. 3 is an exploded perspective view of a refrigerant inlet-outlet tank.
Figure 9:
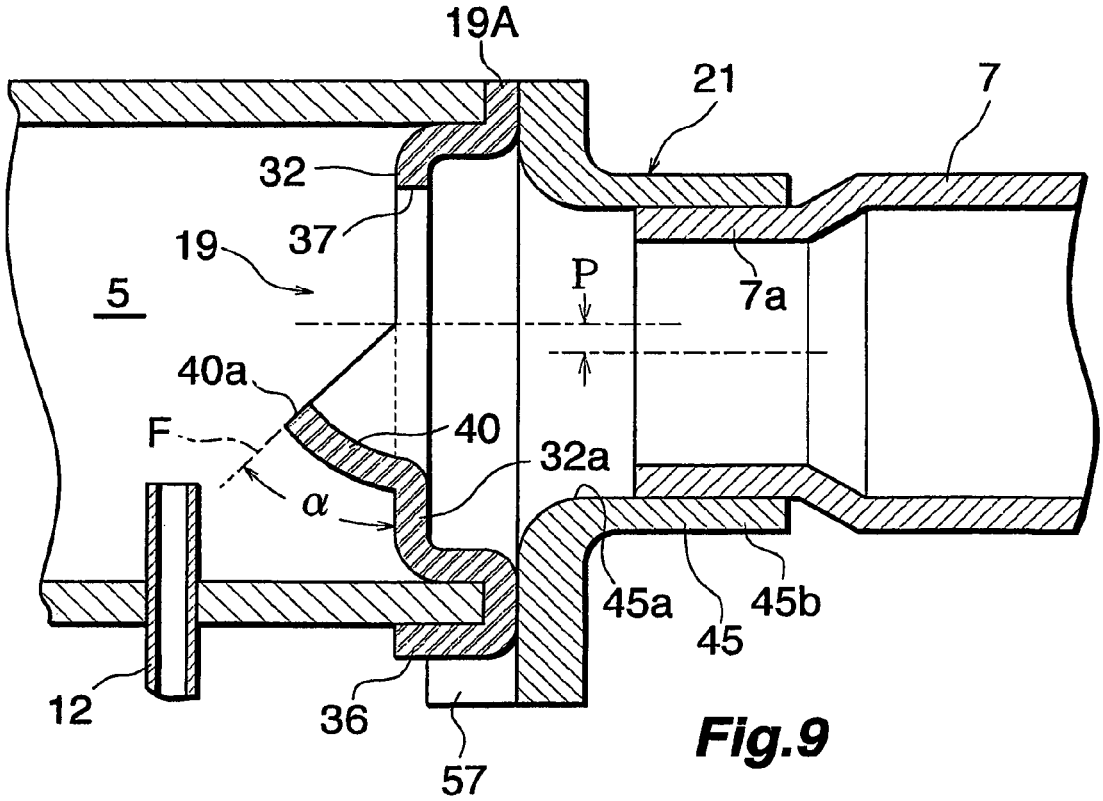
FIG. 9 is an enlarged fragmentary view of FIG. 2.
Figure 10:
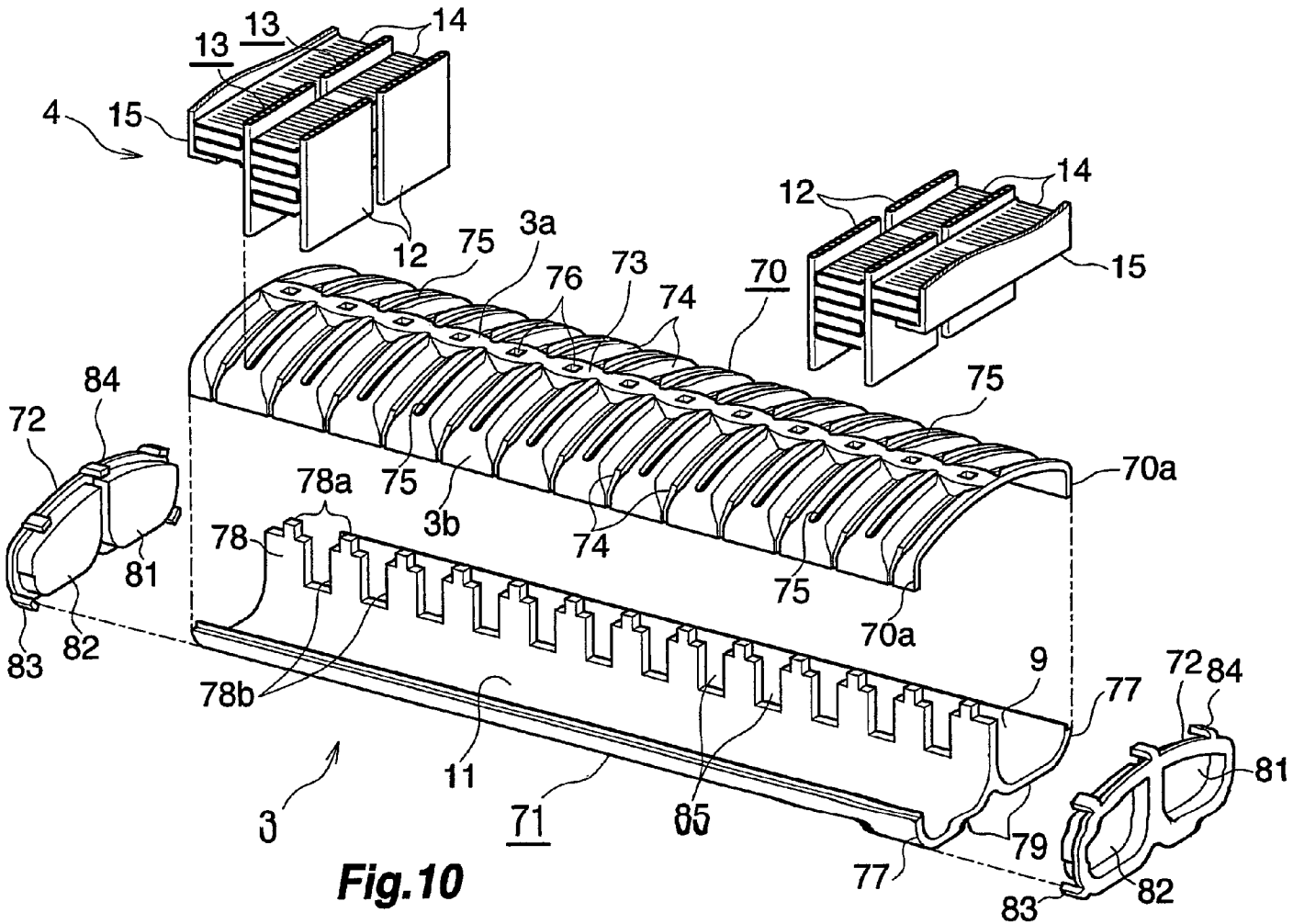
FIG. 10 is an exploded perspective view of a refrigerant turn tank.
Figure 11:
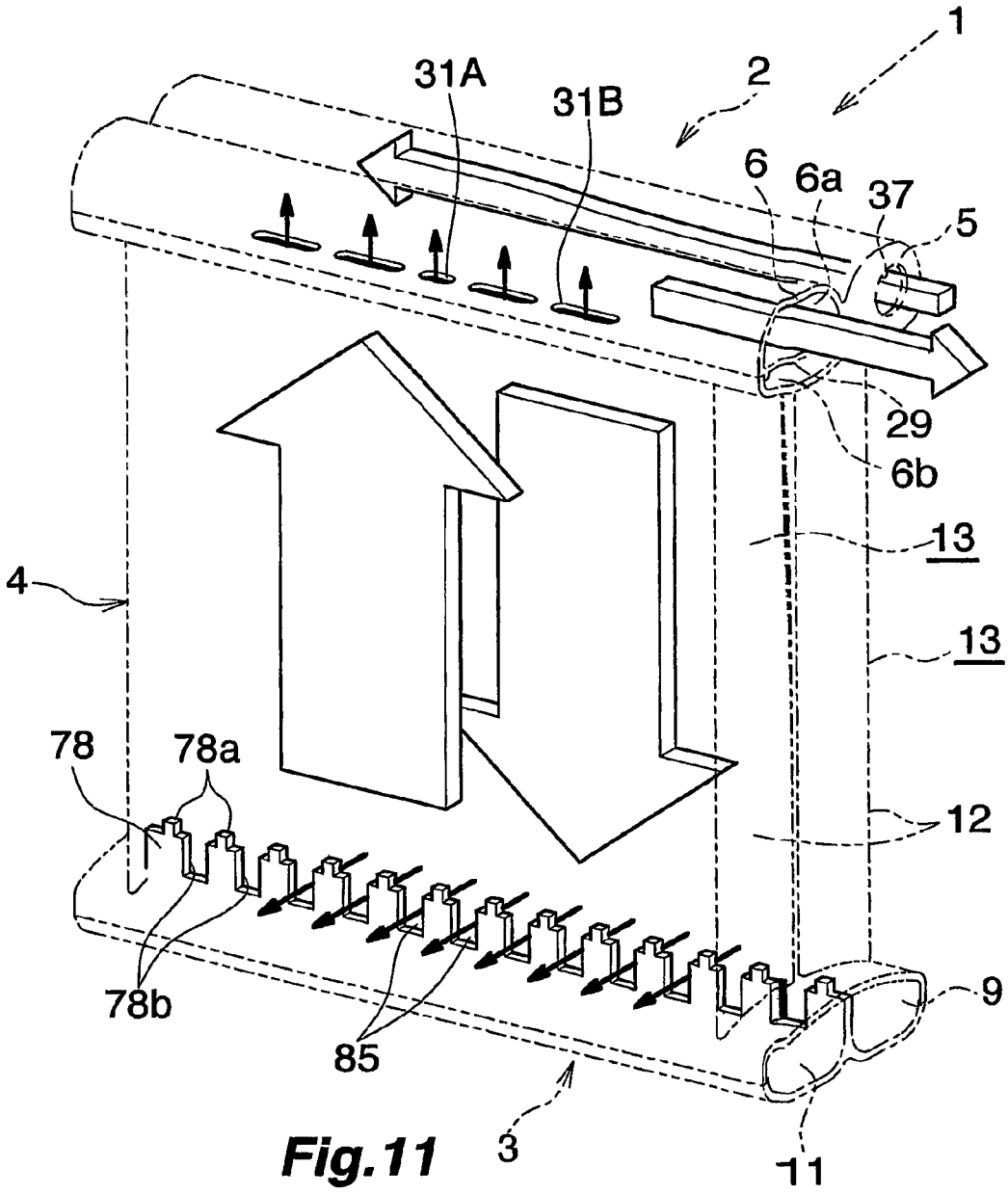
FIG. 11 is a diagram showing how a refrigerant flows through the evaporator shown in FIG. 1.

FIGS. 1 and 2 show the overall construction of a motor vehicle air conditioner evaporator to which the heat exchanger of the invention is applied, FIGS. 3 to 10 show the constructions of main parts, and FIG. 11 shows how a refrigerant flows through the evaporator.

FIGS. 1 and 2 show an evaporator 1 for use in motor vehicle air conditioners wherein a chlorofluorocarbon refrigerant is used. The evaporator 1 comprises a refrigerant inlet-outlet tank 2 of aluminum and a refrigerant turn tank 3 of aluminum which are arranged one above the other as spaced apart, and a heat exchange core 4 provided between the two tanks 2, 3.

The refrigerant inlet-outlet tank 2 comprises a refrigerant inlet header 5 positioned on the front side (the downstream side with respect to the direction of flow of air through the evaporator), and a refrigerant outlet header 6 positioned on the rear side (the upstream side with respect to the flow of air). A refrigerant inlet pipe 7 of aluminum is connected to the inlet header 5 of the tank 2, and a refrigerant outlet pipe 8 of aluminum to the outlet header 6 of the tank. The refrigerant turn tank 3 comprises a refrigerant inflow header 9 (refrigerant inflow intermediate header) positioned on the front side, and a refrigerant outflow header 11 (refrigerant outflow intermediate header) positioned on the rear side.

The heat exchange core 4 comprises tube groups 13 in the form of a plurality of rows, i.e., two rows in the present embodiment, as arranged in parallel in the front-rear direction, each tube group 13 comprising a plurality of heat exchange tubes 12 arranged in parallel in the left-right direction at a spacing. Corrugated fins 14 are arranged respectively in air passing clearances between respective adjacent pairs of heat exchange tubes 12 of tube groups 13 and also outside the heat exchange tubes 12 at the left and right opposite ends of the tube groups 13, and are each brazed to the heat exchange tube 9 adjacent thereto. An aluminum side plate 15 is disposed outside the corrugated fin 14 at each of the left and right ends and brazed to the fin 14. The heat exchange tubes 12 of the front tube group 13 have upper and lower ends projecting into and joined to the inlet header 5 and the inflow header 9, respectively, and the heat exchange tubes 12 of the rear tube group 13 have upper and lower ends projecting into and joined to the outlet header 6 and the outflow header 11, respectively. The inflow header 9, the outflow header 11 and the heat exchange tubes 12 of the tube groups 13 constitute a refrigerant circulating passage for causing the inlet header 5 to communicate with the outlet header 6 therethrough.

With reference to FIGS. 3 to 6, the refrigerant inlet-outlet tank 2 comprises a platelike first member 16 made of an aluminum brazing sheet having a brazing material layer over opposite surfaces thereof and having the heat exchange tubes 12 joined thereto, a second member 17 of bare aluminum extrudate and covering the upper side of the first member 16, and aluminum caps 18, 19 (closing members) made of an aluminum brazing sheet having a brazing material layer over opposite surfaces there and joined to opposite ends of the two members 16, 17 for closing the respective opposite end openings. An aluminum joint plate 21 elongated in the front-rear direction is brazed to the outer surface of the cap 19 at the right end to extend across both the inlet header 5 and the outlet header 6. The refrigerant inlet and outlet pipes 7, 8 are joined to the joint plate 21.

The first member 16 has at each of the front and rear side portions thereof a curved portion 22 in the form of a circular arc of small curvature in cross section and bulging downward at its midportion. The curved portion 22 has a plurality of tube insertion slits 23 elongated in the front-rear direction and arranged at a spacing in the left-right, i.e., lateral, direction. Each corresponding pair of slits 23 in the front and rear curved portions 22 are in the same position with respect to the lateral direction. The front edge of the front curved portion 22 and the rear edge of the rear curved portion 22 are integrally provided with respective upstanding walls 22*a* extending over the entire length of the member 16. The first member 16 includes between the two curved portions 22 a flat portion 24 having a plurality of through holes 25 arranged at a spacing in the lateral direction.

The second member 17 is generally m-shaped in cross section and opened downward and comprises front and rear two walls 26 extending laterally, a partition wall 27 provided in the midportion between the two walls 26 and extending laterally as separating means for dividing the interior of the refrigerant inlet-outlet tank 2 into front and rear two spaces, and two generally circular-arc connecting walls 28 bulging upward and integrally connecting the partition wall 27 to the respective front and rear walls 26 at their upper ends. The rear wall 26 and the partition wall 27 are integrally interconnected at their lower ends over the entire length of the member 17 by a flow dividing resistance plate 29 serving as means for dividing the interior of the outlet header 6 into upper and lower two spaces 6*a*, 6*b*. The resistance plate 29 has refrigerant passing through holes 31A, 31B elongated laterally, formed therein at a rear portion thereof other than the left and right end portions of the plate and arranged at a spacing laterally thereof. The partition wall 27 has a lower end projecting downward beyond the lower ends of the front and rear walls 26 and is integrally provided with a plurality of projections 27*a* projecting downward from the lower edge of the wall 27, arranged at a spacing in the lateral direction and fitted into the through holes 25 of the first member 16. The projections 27*a* are formed by cutting away specified portions of the partition wall 27.

Figure 7:
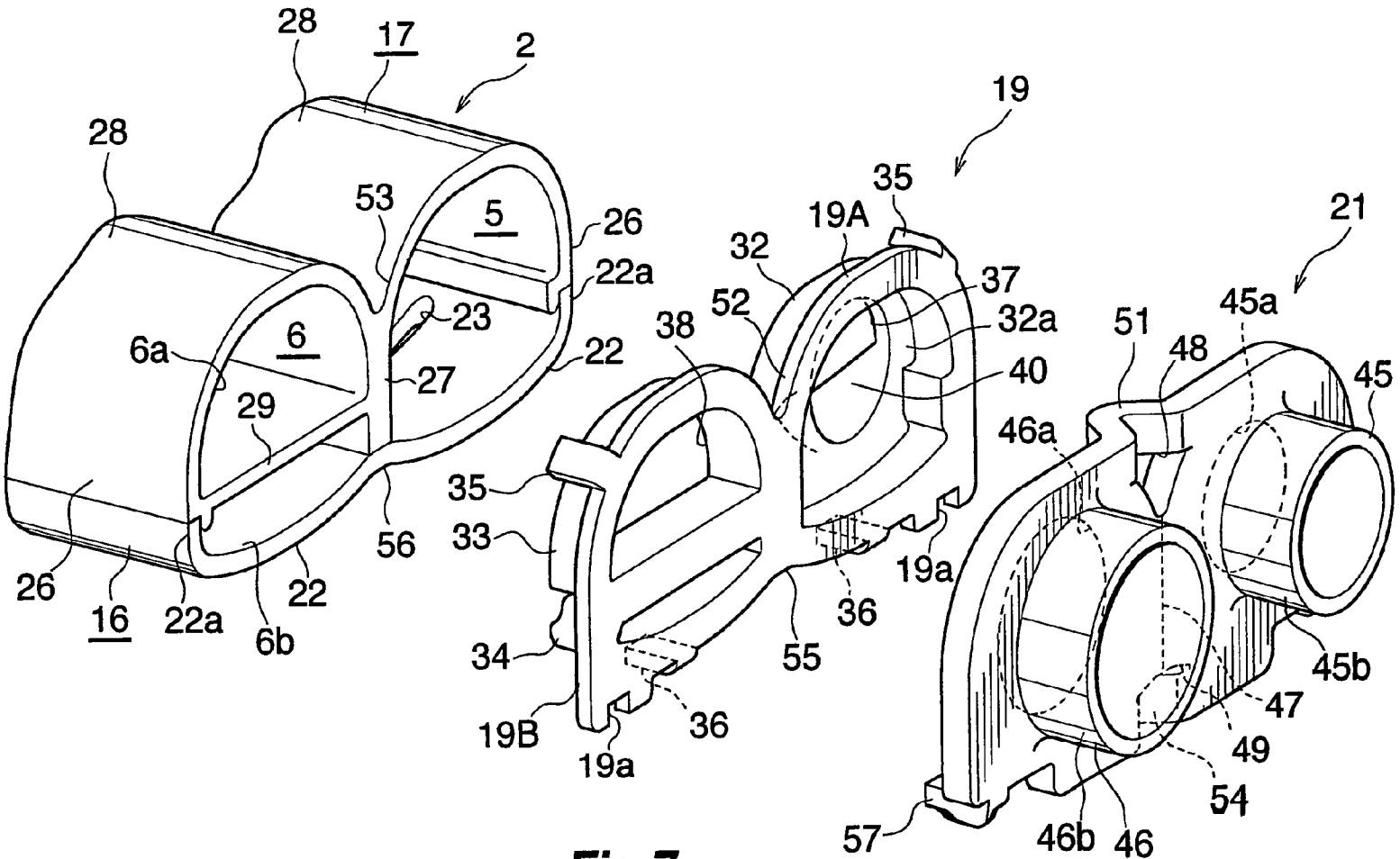
FIG. 7 is an exploded perspective view showing the inlet-outlet tank, a right cap and a joint plate on an enlarged scale.
Figure 8:
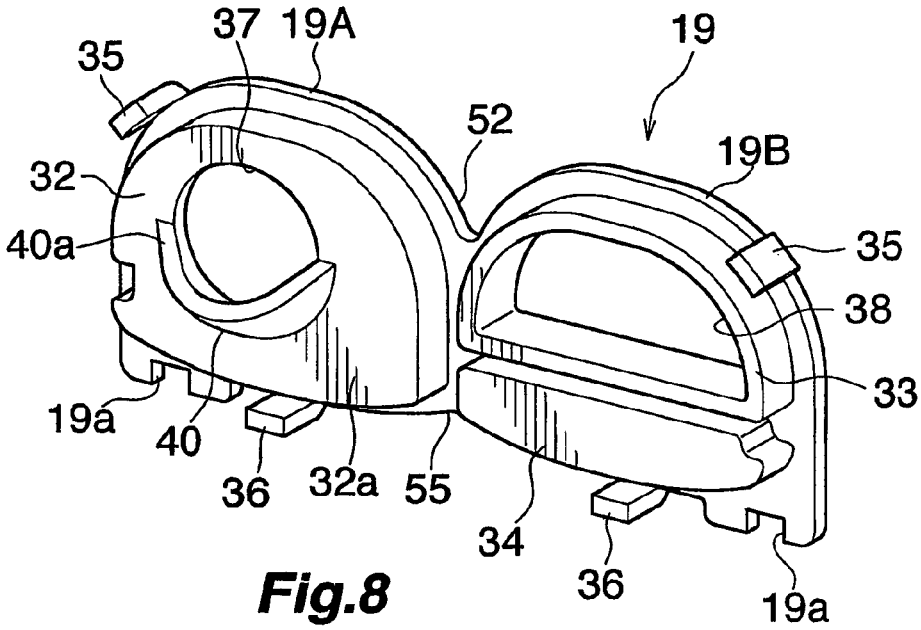
FIG. 8 is a perspective view of the right cap.

With reference to FIGS. 7 to 9, the right cap 19 has a first closing portion 19A for closing the right-end opening of the inlet header 5, and a second closing portion 19B for closing the right-end opening of the outlet header 6. The first closing portion 19A of the right cap 19 is integrally provided with a leftward protrusion 32 to be fitted into the inlet header 5. The second closing portion 19B of the cap 19 is integrally provided with an upper leftward protrusion 33 to be fitted into the upper space 6*a* of the outlet header 6 above the resistance plate 29 and with a lower leftward protrusion 34 positioned below and spaced apart from the protrusion 33 and to be fitted into the lower space 6*b* of the header 6 under the plate 29. The leftward protrusion 32 of the right cap 19 at the front portion thereof has a bottom wall 32*a* provided with a circular refrigerant inlet 37. The upper leftward protrusion 33 of the cap 19 at the rear portion thereof has a bottom wall provided with a refrigerant outlet 38 over the entire wall area. The inlet is preferably 3 to 8.5 mm in inside diameter. The bottom wall 32*a* of the leftward protrusion 32 of the right cap 19 has a vertical inner surface. The bottom wall 32*a* has a lower circular-arc edge defining the inlet 37 and integrally provided with a guide 40 slanting (leftwardly) upward to extend into the inlet header 5 from the inner surface of the wall 32*a*. The guide 40 is in the form of a segment of a sphere and has a projecting end face 40*a* positioned on a slanting plane F inclined with respect to the bottom wall 32*a* of the leftward protrusion 32. The minor angle $\alpha$ between the slanting plane F on which the projecting end face 40*a* of the guide 40 is positioned and the inner surface of the bottom wall 32*a* of the leftward protrusion 32 is preferably 15 to 60 degrees (see FIG. 9). The right cap 19 has an engaging lug 35 projecting leftward and formed integrally therewith on a circular-arc portion between the upper edge thereof and each of the front and rear side edges thereof. The right cap 19 further has an engaging lug 36 projecting leftward and formed integrally therewith on each of front and rear portions of the lower edge thereof.

The left cap 18 is symmetrical to the right cap 19. The left cap 18 has formed integrally therewith a rightward protrusion 39 fittable into the inlet header 5, an upper rightward protrusion 41 fittable into the upper space 6*a* of the outlet header 6 above the resistance plate 29, a lower rightward protrusion 42 fittable into the lower space 6*b* of the header 6 below the resistance plate 29, and upper and lower engaging lugs 43, 44 projecting rightward. No opening is formed in the bottom walls of the rightward protrusion 39 and the upper rightward protrusion 41. The two caps 18, 19 each have an upper edge comprising two generally circular-arc front and rear portions joined to each other in alignment by a midportion so as to conform in shape to the shape of the inlet-outlet tank second member 17. The two caps 18, 19 each have a lower edge comprising two generally circular-arc front and rear portions joined to each other in alignment by a middle flat portion so as to conform in shape to the shape of the inlet-outlet tank first member 16.

The joint plate 21 has a short cylindrical refrigerant inlet portion 45 communicating with the inlet 37 of the right cap 19, and a short cylindrical refrigerant outlet portion 46 communicating with the outlet 38 of the cap. The inlet portion 45 and the outlet portion 46 comprise circular through holes 45*a*, 46*a*, and short cylinders 45*b*, 46*b* projecting rightward and formed around the holes 45*a*, 46*a*, respectively, integrally with the joint plate. The center of the inlet portion 45 is at the same level as that of the outlet portion 46. The short cylinder 45*b* of the inlet portion 45 is smaller than short cylinder 46*b* of the outlet portion 46 in outside diameter. The inlet 37 of the right cap 19 has a center upwardly deviated from the center of the circular through hole 45*a* of the inlet portion 45. This deviation, i.e., the eccentricity P, is preferably 0.5 to 3 mm (see FIG. 9). The joint plate 21 is preferably up to 50 mm in front-to-rear length, and the spacing between the inlet portion 45 and the outlet portion 46 is preferably 6 to 9 mm.

Formed in the portion of the joint plate 21 between the inlet portion 45 and the outlet portion 46 are a vertically extending slit 47 for preventing a short circuit and generally triangular through holes 48, 49 communicating respectively with the upper and lower ends of the slit 47. The slit 47 has a width of preferably up to 1 mm in the front-rear direction. The joint plate 21 has bent portions 51, 54 formed above the upper hole 48 and below the lower hole 49, respectively, and projecting leftward. The upper bent portion 51 is in engagement with engaging portions provided between the inlet header 5 and the outlet header 6, i.e., an engaging portion 52 formed on the upper edge of the right cap 19 between the two generally circular-arc portions thereof, and an engaging portion 53 provided between the two connecting walls 28 of the second ember 17 of the inlet-outlet tank 2. The lower bent portion 54 is in engagement with engaging portions provided between the inlet header 5 and the outlet header 6, i.e., an engaging portion 55 provided by the above-mentioned flat portion formed on the lower edge of the right cap 19 between the two generally circular-arc portions thereof, and an engaging portion 56 comprising the flat portion 24 of the first member 16 of the inlet-outlet tank 2. The joint plate 21 further has engaging lugs 57 projecting leftward and formed integrally with the lower edge thereof respectively at its front and rear ends. The lugs 57 are engaged with the right cap 19, as fitted in recesses 19*a* formed in the lower edge of the cap 19.

A constricted portion 7*a* formed at one end of the inlet pipe 7 is inserted in and brazed to the inlet portion 45 of the joint plate 21, and a constricted portion 8*a* formed at one end of the outlet pipe 8 is inserted in and brazed to the outlet portion 46 of the plate 21. Although not shown, an expansion valve mount member is provided on both the other ends of the inlet pipe 7 and the outlet pipe 8 across both of these pipes.

The first and second members 16, 17 of the refrigerant inlet-outlet tank 2, the two caps 18, 19 and the joint plate 21 are brazed together in the following manner. The first and second members 16, 17 are brazed to each other utilizing the brazing material layer of the first member 16, with the projections 27*a* of the second member 17 inserted through the respective through holes 25 of the first member 16 in crimping engagement therewith and with the upper ends of the front and rear upstanding walls 22*a* of the first member 16 thereby engaged with the lower ends of the front and rear walls 26 of the second member 17. The two caps 18, 19 are brazed to the first and second members 16, 17 utilizing the brazing material layers of the caps 18, 19, with the protrusions 39, 32 of the front portions fitting in the front space inside the two members 16, 17 forwardly of the partition wall 27, with the upper protrusions 41, 33 of the rear portions fitting in the upper space inside the two members 16, 17 rearwardly of the partition wall 27 and above the resistance plate 29, with the lower protrusions 42, 34 of the rear portions fitting in the lower space rearwardly of the partition wall 27 and below the resistance plate 29, with the upper engaging lugs 43, 35 engaged with the connecting walls 28 of the second member 17, and with the lower engaging lugs 44, 36 engaged with the curved portions 22 of the first member 16. The joint plate 21 is brazed to the right cap 19 utilizing the brazing material layer of the cap 19, with the upper bent portion 51 engaged in the upper engaging portion 52 of the cap 19 and in the engaging portion 53 of the second member 17, with the lower bent portion 54 engaged with the lower engaging portion 55 of the cap 19 and with the engaging portion 56 of the first member 16, and with the engaging lugs 57 engaged in the recesses 19*a* formed in the lower edge of the cap 19.

In this way, the refrigerant inlet-outlet tank 2 is made. The portion of the second member 17 forwardly of the partition wall 27 serves as the inlet header 2, and the portion of the member 17 rearward of the partition wall 27 as the outlet header 6. The outlet header 6 is divided by the flow dividing resistance plate 29 into upper and lower spaces 6*a*, 6*b*, which are held in communication by the refrigerant passing holes 31A, 31B. The refrigerant outlet 38 of the right cap 19 is in communication with the upper space 6*a* of the outlet header 6. The refrigerant inlet portion 45 of the joint plate 21 communicates with the refrigerant inlet 37; and the refrigerant outlet portion 46 thereof communicates with the outlet 38.

Figure 4:
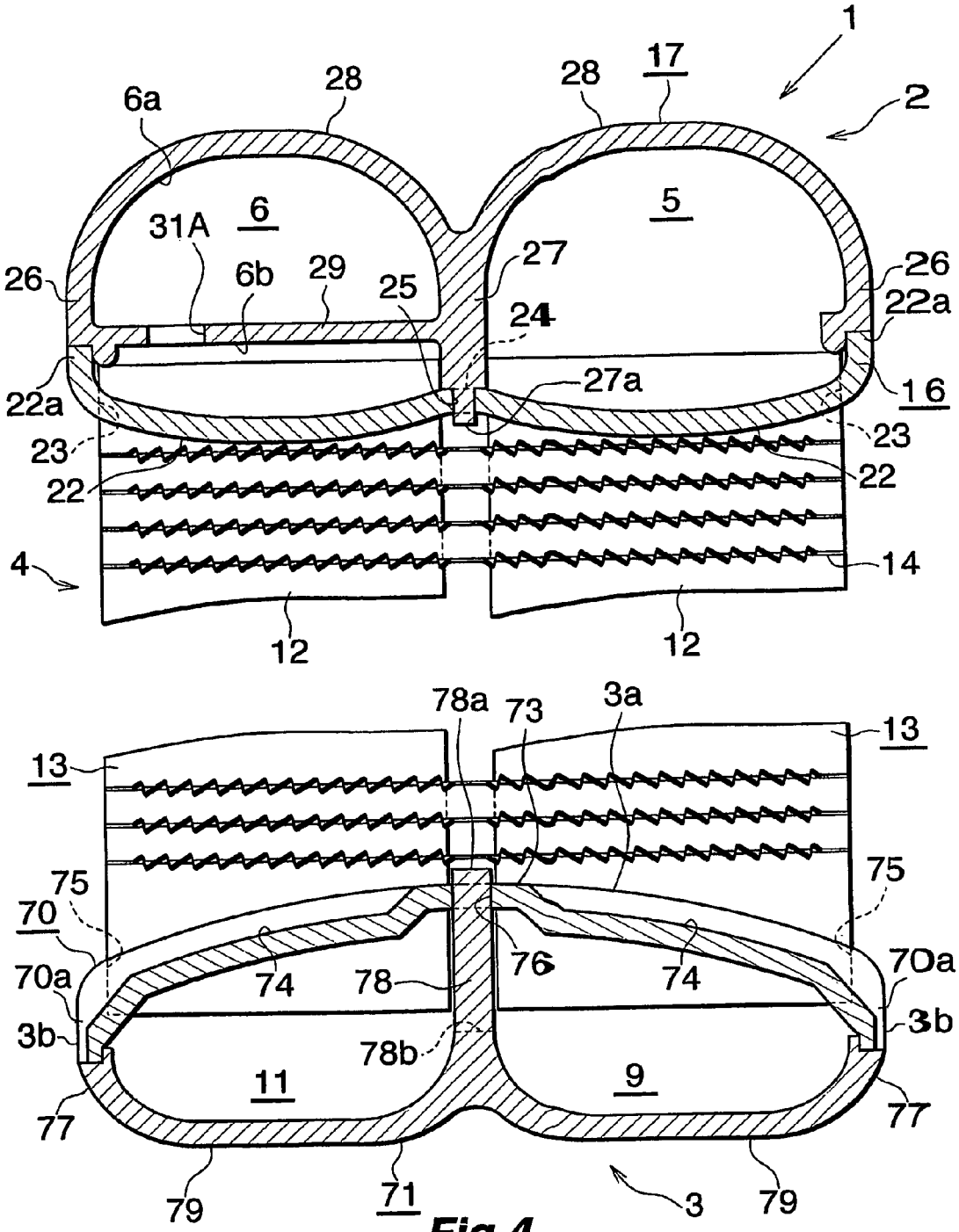
FIG. 4 is an enlarged fragmentary view in section taken along the line A-A in FIG. 2.
Figure 5:
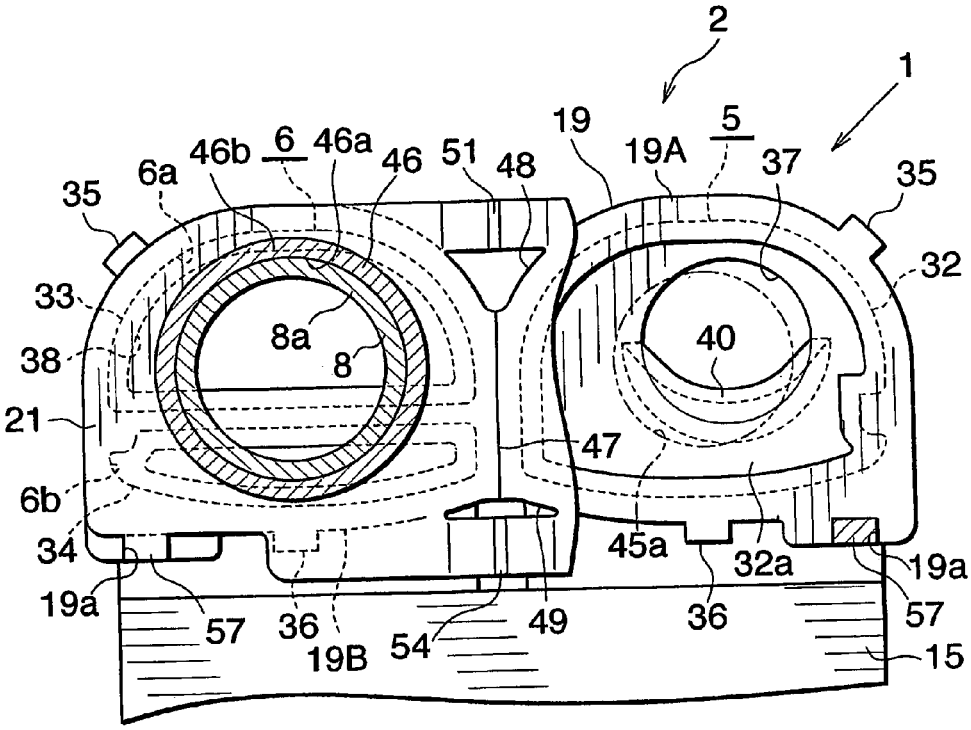
FIG. 5 is an enlarged fragmentary view in section taken along the line B-B in FIG. 2.
Figure 5:
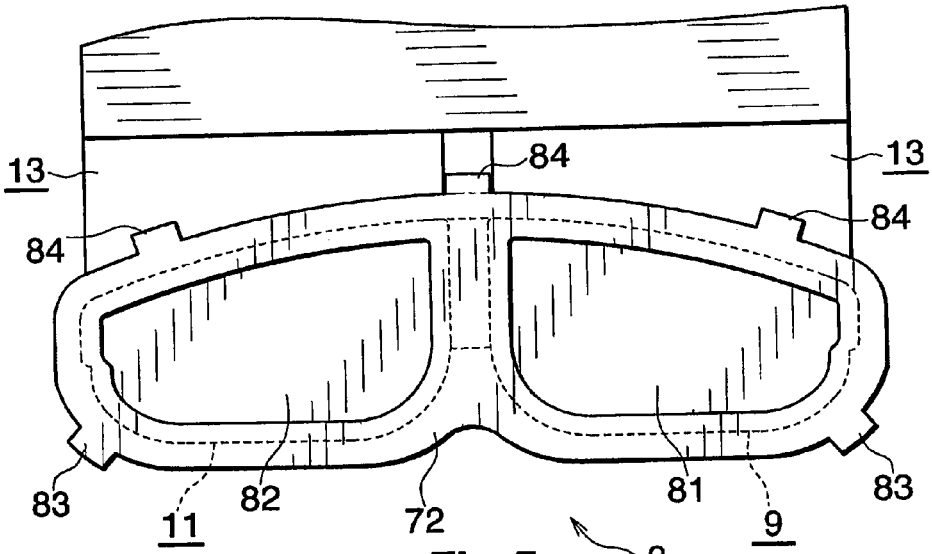
Figure 6:
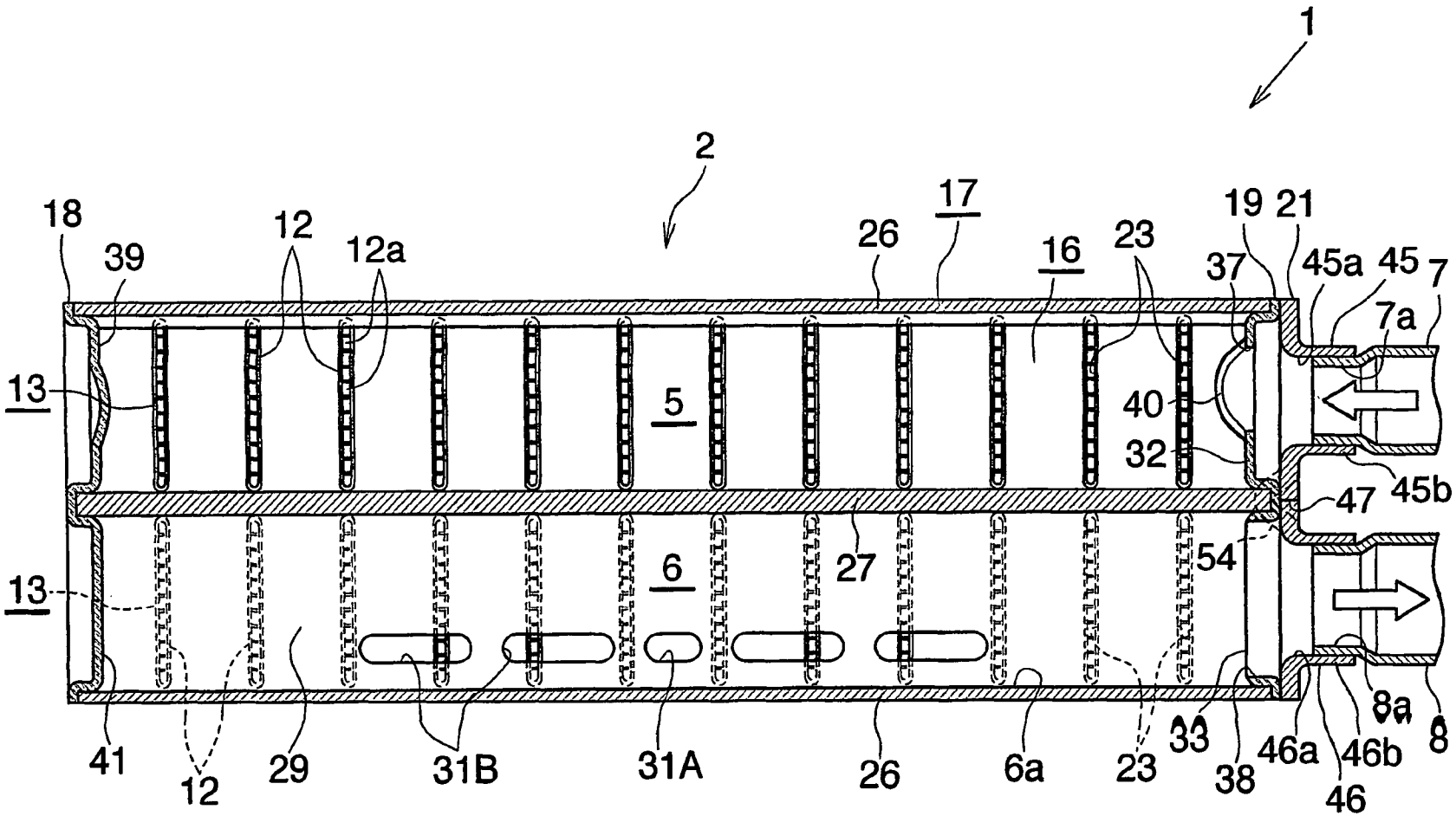
FIG. 6 is a view in section taken along the line C-C in FIG. 2.

With reference to FIGS. 4 and 10, the refrigerant turn tank 3 comprises a platelike first member 70 made of aluminum brazing sheet having a brazing material layer over opposite surfaces thereof and having the heat exchange tubes 12 joined thereto, a second member 71 made of bare aluminum extrudate and covering the lower side of the first member 70, and aluminum caps 72 made of aluminum brazing sheet having a brazing material layer over opposite surfaces thereof for closing left and right opposite end openings.

The refrigerant turn tank 3 has a top surface 3*a* which is in the form of a circular-arc in cross section in its entirety such that the midportion thereof with respect to the front-rear direction is the highest portion 73 which is gradually lowered toward the front and rear sides. The tank 3 is provided in its front and rear opposite side portions with grooves 74 extending from the front and rear opposite sides of the highest portion 73 of the top surface 3*a* to front and rear opposite side surfaces 3*b*, respectively, and arranged laterally at a spacing.

The first member 70 has a circular-arc cross section bulging upward at its midportion with respect to the front-rear direction and is provided with a depending wall 70*a* formed at each of the front and rear side edges thereof integrally therewith and extending over the entire length of the member 70. The upper surface of the first member 70 serves as the top surface 3*a* of the refrigerant turn tank 3, and the outer surface of the depending wall 70*a* as the front or rear side surface 3*b* of the tank 3. The grooves 74 are formed in each of the front and rear side portions of the first member 70 and extend from the highest portion 73 in the midportion of the member 70 with respect to the front-rear direction to the lower end of the depending wall 70*a*. In each of the front and rear side portions of the first member 70 other than the highest portion 73 in the midportion thereof, tube insertion slits 75 elongated in the front-rear direction are formed between respective adjacent pairs of grooves 74. Each corresponding pair of front and rear tube insertion slits 75 are in the same position with respect to the lateral direction. The first member 70 has a plurality of through holes 76 formed in the highest portion 73 in the midportion thereof and arranged laterally at a spacing. The depending walls 70*a*, grooves 74, tube insertions slits 75 and through holes 76 of the first member 70 are formed at the same time by making the member 70 from an aluminum brazing sheet by press work.

The second member 71 is generally w-shaped in cross section and opened upward, and comprises front and rear two walls 77 curved upwardly outwardly forward and rearward, respectively, and extending laterally, a vertical partition wall 78, provided at the midportion between the two walls 77, extending laterally and serving as separating means for dividing the interior of the refrigerant turn tank 3 into front and rear two spaces, and two connecting walls 79 integrally connecting the partition wall 78 to the respective front and rear walls 77 at their lower ends. The partition wall 78 has an upper end projecting upward beyond the upper ends of the front and rear walls 77 and is provided with a plurality of projections 78*a* projecting upward from the upper edge thereof integrally therewith, arranged laterally at a spacing and fitted into the respective through holes 76 in the first member 70. The partition wall 78 is provided with refrigerant passing cutouts 78*b* formed in its upper edge between respective adjacent pairs of projections 78*a*. The projections 78*a* and the cutouts 78*b* are formed by cutting away specified portions of the partition wall 78.

The second member 71 is produced by extruding the front and rear walls 77, partition wall 78 and connecting walls 79 integrally, and cutting the partition wall 78 to form the projections 78*a* and cutouts 78*b*.

The front portion of each of the caps 72 has a laterally inward protrusion 81 formed on the laterally inner side thereof integrally therewith and fittable into the inflow header 9. The rear portion of the cap 72 has a laterally inward protrusion 82 formed on the laterally inner side thereof integrally therewith and fittable into the outflow header 11. Each cap 72 is integrally provided at a circular-arc portion between the lower edge thereof and each of the front and rear side edges thereof with an engaging lug 83 projecting laterally inward, and further has a plurality of engaging lugs 84 arranged at a spacing in the front-rear direction, formed on its upper edge integrally therewith and projecting laterally inward.

The first and second members 70, 71 of the turn tank 3 and the two caps 72 thereof are brazed together in the following manner. The first and second members 70, 71 are brazed to each other utilizing the brazing material layer of the first member 70, with the projections 78*a* of the second member 71 inserted through the respective holes 76 in crimping engagement and with the lower ends of front and rear depending walls 70*a* of the first member 70 in engagement with the upper ends of front and rear walls 77 of the second member 71. The two caps 72 are brazed to the first and second members 70, 71 using the brazing material layers of the caps 72, with the front protrusions 81 fitted in the space defined by the two members 70, 71 and positioned forwardly of the partition wall 78, with the rear protrusions 82 fitted in the space defined by the two members 70, 71 and positioned rearwardly of the partition wall 78, with the upper engaging lugs 84 engaged with the first member 70 and with the lower engaging lugs 83 engaged with the front and rear walls 77 of the second member 71. In this way, the refrigerant turn tank 3 is formed. The portion of the second member 71 forwardly of the partition wall 78 serves as the inflow header 9, and the portion thereof rearwardly of the partition wall 78 as the outflow header 11. The upper-end openings of the cutouts 78*b* in the partition wall 78 of the second member 71 are closed with the first member 70, whereby refrigerant passing holes 85 are formed. The inflow header 9 communicates with the outflow header 11 through the passing holes 85.

The heat exchange tubes 12 providing the front and rear tube groups 13 are each made of an aluminum extrudate. Each tube 12 is flat, has a large width in the front-rear direction and is provided in its interior with a plurality of refrigerant channels 12*a* extending longitudinally of the tube and arranged in parallel (see FIG. 6). The tubes 12 have upper end portions inserted through the slits 23 in the first member 16 of the refrigerant inlet-outlet tank 2 and are brazed to the first member 16 utilizing the brazing material layer of the member 16. The tubes 12 have lower end portions inserted through the slits 75 in the first member 70 of the refrigerant turn tank 3 and are brazed to the first member 70 utilizing the brazing material layer of the member 70.

Preferably, the heat exchange tube 12 is 0.75 to 1.5 mm in height, i.e., in thickness in the lateral direction, 12 to 18 mm in width in the front-rear direction, 0.175 to 0.275 mm in the wall thickness of the peripheral wall thereof, 0.175 to 0.275 mm in the thickness of partition walls separating refrigerant channels from one another, 0.5 to 3.0 mm in the pitch of partition walls, and 0.35 to 0.75 mm in the radius of curvature of the outer surfaces of the front and rear opposite end walls.

In place of the heat exchange tube 12 of aluminum extrudate, an electric resistance welded tube of aluminum may be used which has a plurality of refrigerant channels formed therein by inserting inner fins into the tube. Also usable is a tube which is made from a plate prepared from an aluminum brazing sheet having an aluminum brazing material layer one surface thereof by rolling work and which comprises two flat wall forming portions joined by a connecting portion, a side wall forming portion formed on each flat wall forming portion integrally therewith and projecting from one side edge thereof opposite to the connecting portion, and a plurality of partition forming portions projecting from each flat wall forming portion integrally therewith and arranged at a spacing widthwise thereof, by bending the plate into the shape of a hairpin at the connecting portion and brazing the side wall forming portions to each other in butting relation to form partition walls by the partition forming portions.

The corrugated fin 14 is made from an aluminum brazing sheet having a brazing material layer on opposite sides thereof by shaping the sheet into a wavy form. Louvers are formed as arranged in parallel in the front-rear direction in the portions of the wavy sheet which connect crest portions thereof to furrow portions thereof. The corrugated fins 14 are used in common for the front and rear tube groups 13. The width of the fin 14 in the front-rear direction is approximately equal to the distance from the front edge of the heat exchange tube 12 in the front tube group 13 to the rear edge of the corresponding heat exchange tube 12 in the rear tube group 13. It is desired that the corrugated fin 14 be 7.0 mm to 10.0 mm in fin height, i.e., the straight distance from the crest portion to the furrow portion, and 1.3 to 1.8 mm in fin pitch, i.e., the pitch of connecting portions. Instead of one corrugated fin serving for both the front and rear tube groups 13 in common, a corrugated fin may be provided between each adjacent pair of heat exchange tubes 12 of each tube group 13.

The evaporator 1 is fabricated by tacking the components, other than the refrigerant inlet pipe 7 and outlet pipe 8, in combination and brazing the tacked assembly collectively.

Along with a compressor and a condenser, the evaporator 1 constitutes a refrigeration cycle, which is installed in vehicles, for example, in motor vehicles for use as an air conditioner.

With reference to FIG. 11 showing the evaporator 1 described, a two-layer refrigerant of vapor-liquid mixture phase flowing through a compressor, condenser and expansion valve enters the refrigerant inlet header 5 of the inlet-outlet tank 2 via the refrigerant inlet pipe 7, the refrigerant inlet portion 45 of the joint plate 21 and the refrigerant inlet 37 of the right cap 19 and dividedly flows into the refrigerant channels 12*a* of all the heat exchange tubes 12 of the front tube group 13.

With the inlet 37 positioned as upwardly deviated from the inlet portion 45, the refrigerant flows from the inlet portion 45 toward the inlet 37 obliquely leftwardly upward at this time and further flows obliquely leftwardly upward by being guided by the guide 40. The refrigerant smoothly flows through the inlet header 5 to the left end thereof and uniformly flows into all the heat exchange tubes 12 of the front tube group 13. When the constricted portion 7*a* of the inlet pipe 7 has an inside diameter of 3 to 8.5 mm, the refrigerant to be sent in via the inlet pipe 7 is given a high velocity, therefore easily flows through the inlet header 5 to the left end thereof and uniformly flows into all the heat exchange tubes 12 of the front group 13. This gives a uniform flow rate to the refrigerant flowing through all the tubes 12 of the front group 13 which are joined to the inlet header 5.

The refrigerant flowing into the channels 12*a* of all the heat exchange tubes 12 flows down the channels 12*a*, ingresses into the refrigerant inflow header 9 of the refrigerant turn tank 3. The refrigerant in the header 9 flows through the refrigerant passing holes 85 of the partition wall 78 into the refrigerant outflow header 11.

The refrigerant flowing into the outflow header 11 dividedly flows into the refrigerant channels 12*a* of all the heat exchange tubes 12 of the rear tube group 13, changes its course and passes upward through the channels 12*a* into the lower space 6*b* of the outlet header 6. Since the refrigerant flowing through all the tubes 12 of the front group 13 joined to the inlet header 5 is made uniform in flow rate, the refrigerant flowing through all the heat exchange tubes 12 included in the rear tube group 13 and joined to the outlet header 6 is also made uniform in flow rate. Further the resistance offered by the flow dividing resistance plate 29 to the flow of refrigerant enables the refrigerant to uniformly flow from the outflow header 11 into all heat exchange tubes 12 of the rear tube group 13, also causing the refrigerant to flow from the inlet header 5 into all the tubes 12 of the front tube group 13 more uniformly. As a result, the refrigerant flows through all the heat exchange tubes 12 of the two tube groups 13 in uniform quantities.

Subsequently, the refrigerant flows through the refrigerant passing holes 31A, 31B of the resistance plate 29 into the upper space 6*a* of the outlet header 6 and flows out of the evaporator via the refrigerant outlet 38 of the right cap 19, the outlet portion 46 of the joint plate 21 and the outlet pipe 8. While flowing through the refrigerant channels 12*a* of the heat exchange tubes 12 of the front tube group 13 and the refrigerant channels 12*a* of the heat exchange tubes 12 of the rear tube group 13, the refrigerant is subjected to heat exchange with the air flowing through the air passing clearances in the direction of arrow X shown in FIG. 1 and flows out of the evaporator in a vapor phase.

With the refrigerant flowing through all the tubes 12 of the front group 13 joined to the inlet header 5 made uniform in flow rate, and with the refrigerant flowing through all the heat exchange tubes 12 of the rear tube group 13 joined to the outlet header 6 also made uniform in flow rate, the quantity of refrigerant contributing to refrigeration is uniformalized with respect to the left-right-direction of the heat exchange core 4, and the air passing through the heat exchange core 4 is also uniformalized entirely in temperature, enabling the evaporator 1 to exhibit remarkably improved heat exchange performance. The impairment of heat exchange performance is prevented especially in the case where the flow rate of refrigerant is small.

Water condensate is produced on the surfaces of the corrugated fins 14 to flow down the top surface 3*a* of the turn tank 3 when the refrigerant is subjected to heat exchange with the air flowing through the air passing clearances in the direction of arrow X shown in FIG. 1 while flowing through the refrigerant channels 12*a* of the heat exchange tubes 12 of the front tube group 13 and the refrigerant channels 12*a* of the heat exchange tubes 12 of the rear tube group 13. The condensate flowing down the tank top surface 3*a* enters the grooves 74 by virtue of a capillary effect, flows through the grooves 74 and falls off the forwardly or rearwardly outer ends of the grooves 74 to below the turn tank 3. This prevents a large quantity of condensate from collecting between the top surface 3*a* of the turn tank 3 and the lower ends of the corrugated fins 14, consequently preventing the condensate from freezing due to the collection of large quantity of the condensate, whereby inefficient performance of the evaporator 1 is precluded.

One group 13 of heat exchange tubes is provided between the inlet header 5 and the inflow header 9 of the two tanks 2, 3, as well as between the outlet header 6 and the outflow header 11 thereof according to the foregoing embodiment, whereas this arrangement is not limitative; one or at least two groups 13 of heat exchange tubes may be provided between the inlet header 5 and the inflow header 9 of the two tanks 2, 3, as well as between the outlet header 6 and the outflow header 11 thereof. The evaporator may be used with the turn tank 3 positioned above the inlet-outlet tank 2.

According to the foregoing embodiment, the refrigerant inlet pipe 7 and the refrigerant outlet pipe 8 are joined respectively to the inlet portion 45 and the outlet portion 46 of the joint plate 21, with an expansion valve mount member extending across and secured to both end portions of the pipes 7, 8, whereas the expansion valve mount member may alternatively be joined directly to the joint plate 21.

Although the heat exchanger of the invention is used as an evaporator according to the foregoing embodiment, this mode of embodiments not limitative; the invention is applicable also to various other heat exchangers.

INDUSTRIAL APPLICABILITY

The heat exchanger of the invention is suitable for use as an evaporator in motor vehicle air conditioners which are refrigeration cycles to be installed in motor vehicles.

The invention claimed is:

1. A heat exchanger comprising:

a refrigerant inlet header;

a refrigerant outlet header arranged side by side with the refrigerant inlet header in a front-rear direction at an upper end of the heat exchanger; and a refrigerant circulating passage which holds the two headers in communication therethrough, wherein the inlet header has a refrigerant inlet at one end thereof, the outlet header has a refrigerant outlet at one end thereof alongside the inlet, the refrigerant circulating passage has a plurality of heat exchange tubes which has a plurality of upper portions, respectively, the upper portions of the heat exchange tubes are connected to the inlet header and the outlet header, a refrigerant is flowable into the inlet header from the inlet and thereafter returnable to the outlet header through the circulating passage so as to be sent out from the heat exchanger through the outlet, the refrigerant inlet is provided in a closing member closing an opening of the inlet header at said end thereof, the closing member has a lower edge defining the inlet and provided with a guide slanting upward inwardly of the inlet header, and the guide is in the form of a segment of a sphere and has a projecting end face positioned on a slanting plane inclined with respect to a vertical inner surface of the closing member such that at least a portion of the refrigerant which passes through the inlet makes contact with the guide and is directed to flow obliquely upward along the guide and into the inlet header.

2. A heat exchanger according to claim 1 wherein the refrigerant inlet of the inlet header is circular and has an inside diameter of 3 to 8.5 mm.

3. A heat exchanger according to claim 1 wherein the slanting plane having the projecting end face of the guide positioned thereon makes a minor angle of inclination of 15 to 60 degrees with the vertical inner surface of the closing member.

4. A heat exchanger according to claim 1 wherein the closing member has a first closing portion closing said end opening of the inlet header and a second closing portion closing an opening at said end of the outlet header alongside the inlet, the first closing portion being provided with the refrigerant inlet and the guide, the second closing portion being provided with the refrigerant outlet.

5. A heat exchanger according to claim 1 wherein the inlet header has a joint plate joined to said end thereof and having a refrigerant inlet portion in communication with the refrigerant inlet of the closing member, the refrigerant inlet of the inlet header having a center upwardly deviated from a center of the refrigerant inlet portion of the joint plate.

6. A heat exchanger according to claim 5 wherein the deviation of the center of the refrigerant inlet of the inlet header from the center of the refrigerant inlet portion is 0.5 to 3 mm.

7. A heat exchanger according to claim 5 wherein the joint plate extends across and is joined to both the inlet header and the outlet header, and the plate has a refrigerant outlet portion communicating with the refrigerant outlet in addition to the refrigerant inlet portion in communication with the refrigerant inlet.

8. A heat exchanger according to claim 7 wherein a refrigerant inlet pipe is joined to the refrigerant inlet portion of the joint plate, and a refrigerant outlet pipe is joined to the refrigerant outlet portion thereof.

9. A heat exchanger according to claim 8 wherein the inlet pipe has a constricted portion formed at an end portion thereof and inserted into the refrigerant inlet portion of the joint plate, and the outlet pipe has a constricted portion formed at an end portion thereof and inserted into the refrigerant outlet portion of the joint plate, the inlet pipe and the outlet pipe being joined to the joint plate.

10. A heat exchanger according to claim 7 wherein the joint plate has joined thereto an expansion valve mount member having two refrigerant passageways communicating with the refrigerant inlet portion and the refrigerant outlet portion respectively.

11. A heat exchanger according to claim 1 wherein the refrigerant circulating passage comprises a plurality of intermediate headers.

12. A heat exchanger according to claim 1 wherein the outlet header is disposed in the rear of the inlet header, and the refrigerant circulating passage comprises a refrigerant inflow intermediate header disposed below and opposed to the inlet header and a refrigerant outflow intermediate header disposed below and opposed to the outlet header, the inflow intermediate header being in communication with the outflow intermediate header, the plurality of heat exchange tubes being arranged at a spacing between each of the opposed pair of inlet header and inflow intermediate header and the opposed pair of outlet header and outflow intermediate header to provide a tube group in the form of at least one row and constitute a heat exchange core, the heat exchange tubes of the tube group having opposite ends joined to the respective headers opposed to each other.

13. A heat exchanger according to claim 12 wherein the outlet header has interior partitioned by a dividing device into first and second two spaces arranged in the direction of height, and the heat exchange tubes extend into the first space, the dividing device being provided with a refrigerant passing hole, the second space of the outlet header being in communication with the refrigerant outlet.

14. A heat exchanger according to claim 12 wherein the inlet header and the outlet header are provided by dividing interior of one refrigerant inlet-outlet tank into a front and a rear portion by a separating device.

15. A heat exchanger according to claim 14 wherein the outlet header has interior partitioned by a dividing device into first and second two spaces arranged in the direction of height, and the heat exchange tubes extend into the first space, the dividing device being provided with a refrigerant passing hole, the second space of the outlet header being in communication with the refrigerant outlet, the inlet-outlet tank comprises a first member having the heat exchange tubes joined thereto, a second member brazed to the first member at a portion thereof opposite to the heat exchange tubes and closing members brazed to opposite ends of the first and second members, the separating device and the dividing device being integral with the second member.

16. A refrigeration cycle comprising a compressor, a condenser and an evaporator, the evaporator comprising a heat exchanger according to claim 1.

17. A vehicle having installed therein a refrigeration cycle according to claim 16 as a vehicle air conditioner.

* * * * *